US005937548A

United States Patent [19]

Theurer et al.

[11] Patent Number: 5,937,548

[45] Date of Patent: Aug. 17, 1999

[54] MACHINE FOR WITHDRAWING BULK MATERIAL FROM A TRACK

[75] Inventors: Josef Theurer, Vienna; Herbert Wörgötter, Gallneukirchen, both of Austria

[73] Assignee: Franz Plasser Bahnbaumaschinen-Industriegesellschaft m. b. H., Vienna, Austria

[21] Appl. No.: 08/905,065

[22] Filed: Aug. 1, 1997

[30] Foreign Application Priority Data

Aug. 29, 1996 [AT] Austria ..... 1542/96

[51] Int. Cl.[6] ..... E02F 5/22

[52] U.S. Cl. ..... 37/104; 104/2; 171/16

[58] Field of Search ..... 37/104; 104/2; 171/16

[56] References Cited

U.S. PATENT DOCUMENTS

| | | | |
|---|---|---|---|
| 2,142,208 | 1/1939 | Protzeller | 171/16 |
| 4,042,035 | 8/1977 | Boyer | 171/16 |
| 4,674,208 | 6/1987 | Whitaker, Jr. | 37/104 |
| 4,835,887 | 6/1989 | Theurer | 37/104 |
| 5,084,989 | 2/1992 | Theurer et al. | 37/104 |
| 5,094,018 | 3/1992 | Theurer et al. | 37/104 |
| 5,101,584 | 4/1992 | Theurer et al. | 37/104 |
| 5,109,775 | 5/1992 | Kershaw et al. | 104/2 |
| 5,289,648 | 3/1994 | Theurer et al. | 37/104 |
| 5,513,452 | 5/1996 | Theurer et al. | 37/104 |

FOREIGN PATENT DOCUMENTS

| | | | |
|---|---|---|---|
| 2270943 | 3/1994 | United Kingdom | 171/16 |

*Primary Examiner*—Thomas B. Will
*Assistant Examiner*—Gary S. Hartmann
*Attorney, Agent, or Firm*—Henry M. Feiereisen

[57] ABSTRACT

A machine for withdrawing bulk material from a track, in particular ballast material, includes a bulk material clearing device vertically adjustably secured to a machine frame and including a rotatable, endless scraper chain positioned between the rails of the track immediately above the track. A first conveyor extends in longitudinal direction of the machine frame and has a receiving end which receives bulk material from the clearing device. Immediately trailing the clearing device in the operating direction is a vertically adjustable sweeping device which includes a sweeping broom rotatable about a pivot axis extending horizontal and perpendicular to the longitudinal direction of the machine frame. A second conveyor immediately trails the sweeping device in the longitudinal direction of the machine frame and includes a receiving end for receiving bulk material from the sweeping broom.

7 Claims, 1 Drawing Sheet

MACHINE FOR WITHDRAWING BULK MATERIAL FROM A TRACK

BACKGROUND OF THE INVENTION

The present invention refers generally to a ballast bed rehabilitation machine, and more particularly to a machine for withdrawing bulk material, in particular ballast, from a track, having a vertically adjustable bulk material clearing device which is connected to a machine frame and includes a rotatable, endless scraper chain positioned between rails of the track immediately above the track, and a conveyor having a receiving end associated to the bulk material clearing device and extending in a longitudinal direction of the machine frame.

U.S. Pat. No. 5,513,452 describes a ballast bed rehabilitation machine of this type, with the bulk material clearing device being mounted on a leading machine, as viewed in the operating direction. Trailing the leading machine is a ballast bed cleaning machine which is equipped with an excavating chain guided around the track for taking up dirty ballast, and with a conveyor for transport of excavated ballast to a screening unit. The bulk material clearing device is used to take up new ballast which has been temporarily stored between track rails on the track. After being taken up, the new ballast is transported by a trailing conveyor via the transverse chain course which extends underneath the track, and is discharged to the exposed subgrade. In addition, dirty ballast cleaned by the screening unit is deposited on the subgrade. This type of rehabilitation machine affords the possibility to simplify the overall transport logistics in conjunction with a temporary storage of new ballast on the track to complement the deposit of cleaned ballast, if necessary.

U.S. Pat. No. 5,090,483 discloses a mobile track-bound installation combining two cleaning machines arranged successively in an operating direction. The leading cleaning machine includes two excavating chains revolving in the longitudinal direction and spaced from one another transversely to the longitudinal direction for removing dirty ballast from the shoulder area of the track. After being cleaned in a trailing screening unit, cleaned ballast is discharged between the rails of the track and temporarily stored. The trailing cleaning machine includes an endless ballast excavating chain which is guided around the track and is formed with a transverse chain course extending underneath the track for excavating ballast. Positioned above the transverse chain course immediately above the ties is a bridge which is preceded by a rotatable sweeping broom to slightly raise the temporarily stored cleaned ballast from the ties and to transfer it onto the bridge. The bridge is formed substantially by a conveyor belt extending in track direction and discharging the cleaned ballast portion in the continuously advancing excavated ballast bed gap onto the exposed subgrade immediately behind the transverse excavating chain course. Such a mobile installation permits a significant increase of the cleaning performance by using a total of three excavating chains and two screening units.

SUMMARY OF THE INVENTION

It is an object of the present invention to provide an improved bulk material withdrawal machine which in a more effective way is capable of taking up bulk material, e.g. ballast, that is temporarily stored on the track.

This object, and others which will become apparent hereinafter, are attained in accordance with the present invention by providing a bulk material clearing device which is vertically adjustably secured to a machine frame and includes a rotatable, endless scraper chain positioned between rails of the track immediately above the track and cooperating with a first conveyor extending in longitudinal direction of the machine frame, and a vertically adjustable sweeping device which trails the bulk material clearing device in the operating direction and includes a sweeping broom which is rotatable about a pivot axis extending horizontal and perpendicular to the longitudinal direction of the machine frame, and cooperates with a second conveyor which trails the sweeping broom.

Through the combination of a sweeping broom and the associated second conveyor unit, temporarily stored ballast which has not been picked up by the clearing device and is deposited directly on the ties or between the ties can be reclaimed and used again. Thus, 100% of the temporarily stored ballast can be recovered in a cost-efficient manner and included within the rehabilitation process for complete renewal of the ballast bed.

Suitably, the first conveyor has a discharge end which is positioned above the second conveyor, with the discharge end of the second conveyor projecting beyond the trailing end of the machine frame.

According to another feature of the present invention, a discharge hopper may be positioned between the discharge end of the first conveyor and the second conveyor, and two plow shields may be provided which are spaced from one another in a direction transversely to the machine frame and secured to the leading end of the bulk material clearing device, with a drive pivoting the plow shields about a vertical axis.

According to still another feature of the present invention, the machine frame is supported on spaced-apart undercarriages for mobility on the track in the operating direction and has an upwardly recessed frame section, with the bulk material clearing device and the trailing sweeping device being arranged in the longitudinal direction of the machine frame between the undercarriages underneath the upwardly recessed frame section of the machine frame.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
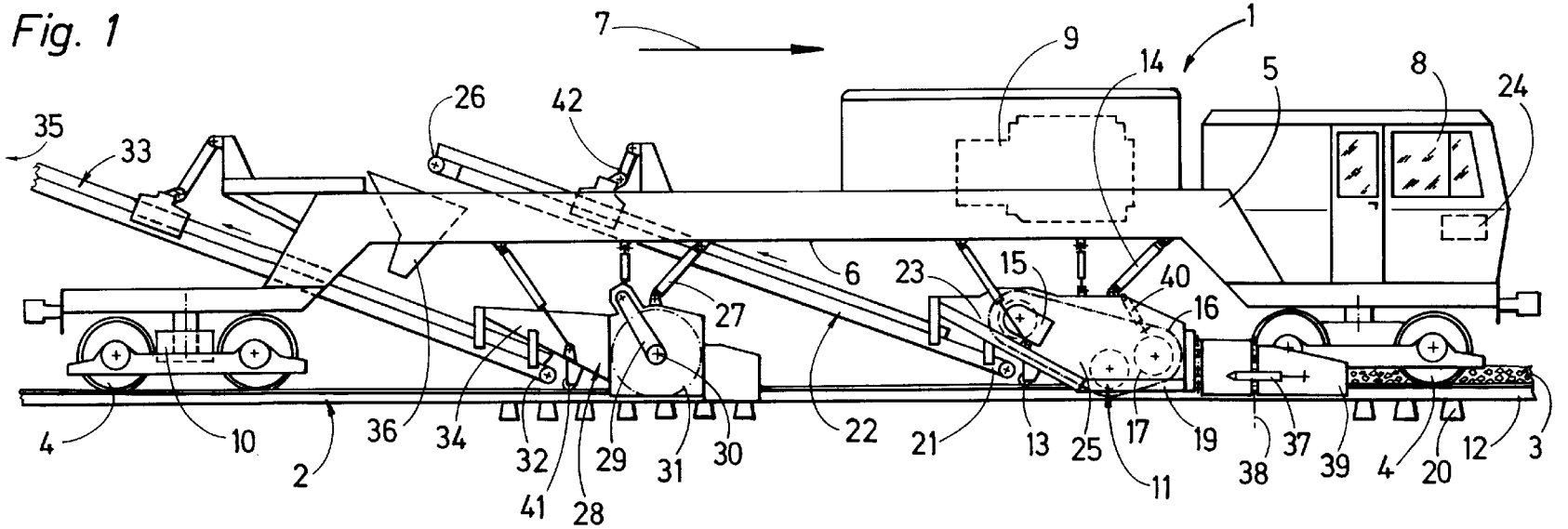
FIG. 1 is a side elevational view of a bulk material withdrawal machine according to the present invention.

Throughout all the Figures, the same or corresponding elements are generally indicated by the same reference numerals.

Turning now to the drawing, and in particular to FIG. 1, there is shown a side elevational view of a bulk material withdrawal machine according to the present invention, generally designated by reference numeral 1, for taking up bulk material 3 deposited on a track 2 which is comprised of rails 12 fastened by ties 20. The machine 1 includes an elongated machine frame, generally designated by reference numeral 5 and formed with an upwardly recessed frame section 6. The machine frame 5 has opposite axial ends supported on the track 2 by undercarriages 4 for mobility of the machine frame 5 on the track 2 in an operating direction, indicated by arrow 7. A drive 10 is incorporated in the rear undercarriage 4 for advancing the machine 1 in the operating direction, with a motor unit 9 being secured to the frame section 6 for supplying power to all operating drives and the drive 10.

Immediately behind the front undercarriage 4 is a bulk material clearing device, generally denoted by reference numeral 11 and supported by flanged rollers 13 for rolling along the rails 12 of the track 2. The clearing device 11 is mounted to the frame section 6 of the machine frame 5 by drives 14 that allow adjustment of the clearing device 11 in a vertical direction. The clearing device 11 includes an endless scraper chain 16 which is rotatable by a drive 15 and takes up bulk material 3 lying on the track 2. The scraper chain 16 is supported by deflection pulleys 17 defined by horizontal axes that extend perpendicular to the longitudinal direction of the machine frame 5, for effecting a rotation of the scraper chain 16 in a vertical rotational plane oriented longitudinally in direction of the machine frame 5.

Figure 2:
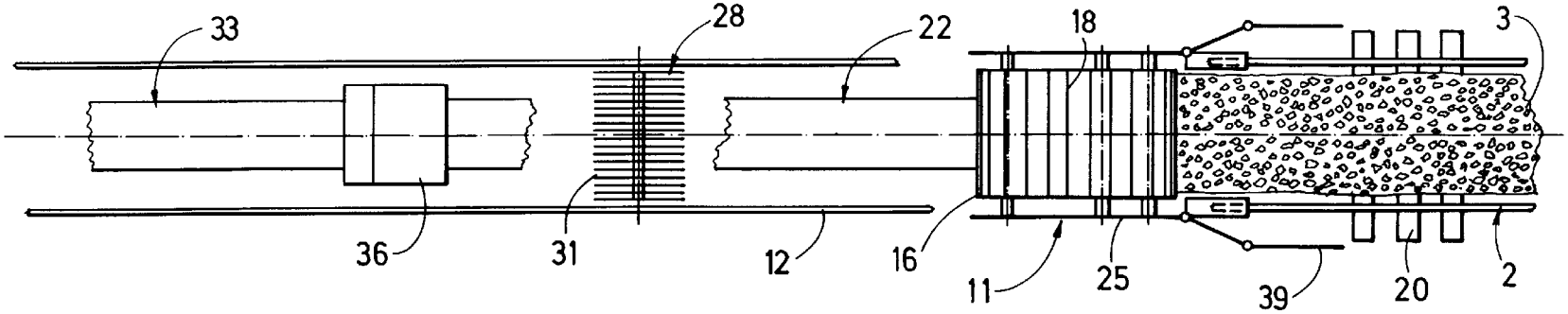
FIG. 2 is a schematic, simplified top view of the machine of FIG. 1.

The scraper chain 16 is formed with engagement members 18 (FIG. 2) and has a lower receiving zone 19 which, during operation, is positioned immediately above the ties 20 of the track 2. Extending in longitudinal direction of the machine frame 5 is a first conveyor unit 22 which has a discharge end 26 and a receiving end 21 positioned directly under a discharge end 23 of the scraper chain 16. The receiving end 21 of the conveyor unit 22 is connected to a carrier frame 25 that carries the scraper chain 16 and the deflection pulleys 17 and is supported by the flanged roller 13 on the track 2. The conveyor unit 22 is swingably mounted suspension gear 42 to the machine frame 5 at an area proximate to the discharge end 26 of the conveyor unit 22.

Immediately following the bulk material clearing device 11 in the operating direction 7 is a sweeping device 28 which is vertically adjustable by drives 27 and is accommodated in a carrier frame 34 supported on flanged rollers 41 for mobility on the track 2. The sweeping device 28 includes a sweeping broom 31 which is linked to the machine frame 5 by a drive 29 for rotating the sweeping broom 31 about a horizontal pivot axis 30 extending perpendicular to the longitudinal direction of the machine frame 5. The sweeping broom 31 cooperates with a receiving end 32 of an immediately trailing second conveyor unit 33 which extends longitudinally in direction of the machine frame 5. The second conveyor unit 33 is secured to the carrier frame 34 of the sweeping device 28 and has a discharge end 35 projecting outwardly beyond the rear end of the machine frame 5. A discharge hopper 36 is disposed between the discharge end 26 of the first conveyor unit 22 and the second conveyor unit 33 for transfer of bulk material from the conveyor unit 22 to the conveyor unit 33.

The bulk material clearing device 11 further cooperates with two plow shields 39 which are positioned at the front end, as viewed in the operating direction 7, of the clearing device 11 and spaced from one another transversely to the longitudinal direction of the machine frame 5. The plow shields 39 are linked to a drive 37 for swinging about a vertical axis 38, while the scraper chain 16 is vertically adjustable by a drive 40 relative to the carrier frame 25.

Before operation of the rehabilitation machine 1, bulk material 3 in the form of clean ballast is deposited between the rails 12 of the track 2. During operation, the rehabilitation machine 1 is continuously advanced in the operating direction 7, with the clearing device 11 rolling via the flanged rollers 13 on the rails 12 while the scraper chain 16 revolves in clockwise direction to take up the clean ballast from the track 2. The clean ballast cleared from the track 2 is conveyed to the trailing conveyor unit 22 and discharged into the discharge hopper 36 for delivery onto the subjacent second conveyor unit 33. Thus, clean ballast can be used as supplement for renewal of the ballast bed and is conveyed by the conveyor unit 33 to a trailing machine (not shown) for ballast cleaning or complete excavation.

At the same time, the sweeping device 28 is operated and lowered by the drives 27 with the flanged rollers 41 onto the rails 12 of the track 2, and the sweeping broom 28 is set into rotation by the drive 29. Thus, while bulk material is taken up by the leading clearing device 11, remaining ballast which has not been removed by the clearing device 11 and lies on the ties 20 or between the ties 20 is thus picked up by the sweeping device 28 and transferred onto the second conveyor unit 33 for transport to the trailing (not shown) ballast cleaning machine.

Persons skilled in the art will understand that the rehabilitation machine according to the present invention may certainly be utilized to take up pre-deposited fine gravel instead of ballast for laying a protective layer of sand on the exposed subgrade.

While the invention has been illustrated and described as embodied in a machine for withdrawing bulk material from a track, it is not intended to be limited to the details shown since various modifications and structural changes may be made without departing in any way from the spirit of the present invention.

What is claimed as new and desired to be protected by Letters Patent is set forth in the appended claims:

1. A machine for taking up bulk material from a track;

a machine frame traveling in an operating direction;

a bulk material clearing device vertically adjustably secured to the machine frame and including a rotatable, endless scraper chain positioned between rails of the track immediately above the track;

a first conveyor extending in longitudinal direction of the machine frame and having a receiving end cooperating with the bulk material clearing device;

a vertically adjustable sweeping device immediately trailing the bulk material clearing device in the operating direction and including a sweeping broom rotatable about a pivot axis extending horizontal and perpendicular to the longitudinal direction of the machine frame; and a second conveyor immediately trailing the sweeping device and extending in the longitudinal direction of the machine frame, said second conveyor including a receiving end cooperating with the sweeping broom.

2. The machine of claim 1 wherein the machine frame has a leading end and a trailing end in the operating direction, said first conveyor having a discharge end cooperating with the bulk material clearing device and positioned above the second conveyor, and said second conveyor having a discharge end projecting beyond the trailing end of the machine frame.

3. The machine of claim 2, and further comprising a discharge hopper positioned between the discharge end of the first conveyor and the second conveyor.

4. The machine of claim 1 wherein the machine frame is supported on the track by spaced-apart undercarriages for mobility in the operating direction and has an upwardly recessed frame section, said bulk material clearing device and said trailing sweeping device being arranged in the longitudinal direction of the machine frame between the undercarriages underneath the frame section of the machine frame.

5. The machine of claim 1 wherein the bulk material clearing device has a trailing end and a leading end in the operating direction, and further comprising two plow shields spaced from one another in a direction transversely to the machine frame and secured to the leading end of the bulk material clearing device, and a drive for pivoting the plow shields about a vertical axis.

6. The machine of claim 1 wherein the bulk material clearing device includes a carrier frame supported on flanged rollers for mobility on the track and carrying the scraper chain, and further comprising a drive for vertically adjusting the scraper chain relative to the carrier frame.

7. The machine of claim 6 wherein the receiving end of the first conveyor is connected to the carrier frame, with the first conveyor being swingably mounted to the machine frame in an area adjacent the discharge end of the first conveyor.

* * * * *